US006182382B1

(12) United States Patent
Skinner

(10) Patent No.: US 6,182,382 B1
(45) Date of Patent: Feb. 6, 2001

(54) BOOT LEG OPENING COVER ATTACHMENT

(76) Inventor: Lee M. Skinner, 132 Balgores Lane, Gidea Park, Romford, Essex RM2 5JX (GB)

( * ) Notice: Under 35 U.S.C. 154(b), the term of this patent shall be extended for 0 days.

(21) Appl. No.: 09/353,955

(22) Filed: Jul. 15, 1999

(51) Int. Cl.[7] ..... A43B 5/00; A43B 23/00; A43D 3/00

(52) U.S. Cl. ..... 36/136; 36/1; 36/132; 12/128 R

(58) Field of Search ..... 36/1, 5, 132, 136, 36/70 R, 2 R, 2.6; 12/114.2, 114.6, 114.8, 128 C, 128 R, 128 B; 224/609; 34/80, 95, 95.1, 104, 105, 107

(56) References Cited

U.S. PATENT DOCUMENTS 4,497,080 * 2/1985 Inspector ..... 12/128 R
4,771,553 * 9/1988 Smithdeal .
5,513,787 * 5/1996 Reed .
5,785,223 * 7/1998 Matsushita .
5,950,323 * 9/1999 Wroth et al. .

* cited by examiner

*Primary Examiner*—M. D. Patterson
*Assistant Examiner*—Anthony Stashick

(57) ABSTRACT

A boot leg opening cover attachment for attachment to a pair of boots to cover the upper leg openings of the boots to prevent precipitation and debris from entering the boots. The boot leg opening cover attachment includes a pair of cover members each having upper and lower faces and a lower perimeter edge. Each of the cover members is designed for position over a boot leg opening of an associated boot to cover the respective boot leg opening. A clip connects the lower perimeter side edges of the cover members together. The clip is designed for attachment to adjacent portions of the boots to attach the cover members to the boots.

17 Claims, 4 Drawing Sheets

BOOT LEG OPENING COVER ATTACHMENT

BACKGROUND OF THE INVENTION

1. Field of the Invention

The present invention relates to attachments for covering the upper leg opening of a boot and more particularly pertains to a new boot leg opening cover attachment for attachment to a pair of boots to cover the upper leg openings of the boots to prevent precipitation and debris from entering the boots.

2. Description of the Prior Art

The use of attachments for covering the upper leg opening of a boot is known in the prior art. More specifically, attachments for covering, the upper leg opening of a boot heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,719,997; 3,128,565; 4,788,996; 5,313,719; 5,005,623; and 5,251,386.

While these devices fulfill their respective, particular objectives and requirements, the aforementioned patents do not disclose a new boot leg opening cover attachment. The inventive device includes a pair of cover members each having upper and lower faces and a lower perimeter edge. Each of the cover members is designed for position over a boot leg opening of an associated boot to cover the respective boot leg opening. A clip connects the lower perimeter side edges of the cover members together. The clip is designed for attachment to adjacent portions of the boots to attach the cover members to the boots.

In these respects, the boot leg opening cover attachment according to the present invention substantially departs from the conventional concepts and designs of the prior art, and in so doing provides an apparatus primarily developed for the purpose of attachment to a pair of boots to cover the upper leg openings of the boots to prevent precipitation and debris from entering the boots.

SUMMARY OF THE INVENTION

In view of the foregoing disadvantages inherent in the known types of attachments for covering the upper leg opening of a boot now present in the prior art, the present invention provides a new boot leg opening cover attachment construction wherein the same can be utilized for attachment to a pair of boots to cover the upper leg openings of the boots to prevent precipitation and debris from entering the boots.

The general purpose of the present invention, which will be described subsequently in greater detail, is to provide a new boot leg opening cover attachment apparatus and method which has many of the advantages of the attachments for covering the upper leg opening of a boot mentioned heretofore and many novel features that result in a new boot leg opening cover attachment which is not anticipated, rendered obvious, suggested, or even implied by any of the prior art attachments for covering the upper leg opening of a boot, either alone or in any combination thereof.

To attain this, the present invention generally comprises a pair of cover members each having upper and lower faces and a lower perimeter edge. Each of the cover members is designed for position over a boot leg opening of an associated boot to cover the respective boot leg opening. A clip connects the lower perimeter side edges of the cover members together. The clip is designed for attachment to adjacent portions of the boots to attach the cover members to the boots.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new boot leg opening cover attachment apparatus and method which has many of the advantages of the attachments for covering the upper leg opening of a boot mentioned heretofore and many novel features that result in a new boot leg opening cover attachment which is not anticipated, rendered obvious, suggested, or even implied by any of the prior art attachments for covering the upper leg opening of a boot, either alone or in any combination thereof.

It is another object of the present invention to provide a new boot leg opening cover attachment which may be easily and efficiently manufactured and marketed.

It is a further object of the present invention to provide a new boot leg opening cover attachment which is of a durable and reliable construction.

An even further object of the present invention is to provide a new boot leg opening, cover attachment which is susceptible of a low cost of manufacture with regard to both materials and labor, and which accordingly is then susceptible of low prices of sale to the consuming public, thereby making such boot leg opening cover attachment economically available to the buying public.

Still yet another object of the present invention is to provide a new boot leg opening cover attachment which provides in the apparatuses and methods of the prior art some of the advantages thereof, while simultaneously overcoming some of the disadvantages normally associated therewith.

Still another object of the present invention is to provide a new boot leg opening cover attachment for attachment to a pair of boots to cover the upper leg openings of the boots to prevent precipitation and debris from entering the boots.

Yet another object of the present invention is to provide a new boot leg opening, cover attachment which includes a pair of over members each having upper and lower faces and a lower perimeter edge. Each of the cover members is designed for position over a boot leg opening of an associated boot to cover the respective boot leg opening. A clip connects the lower perimeter side edges of the cover members together. The clip is designed for attachment to adjacent portions of the boots to attach the cover members to the boots.

Still yet another object of the present invention is to provide a new boot leg opening cover attachment that is designed for use with rubber boots also known a galoshes and Wellingtons to keep the interior of the boots dry even when left outside during precipitation such as rain, sleet and snow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
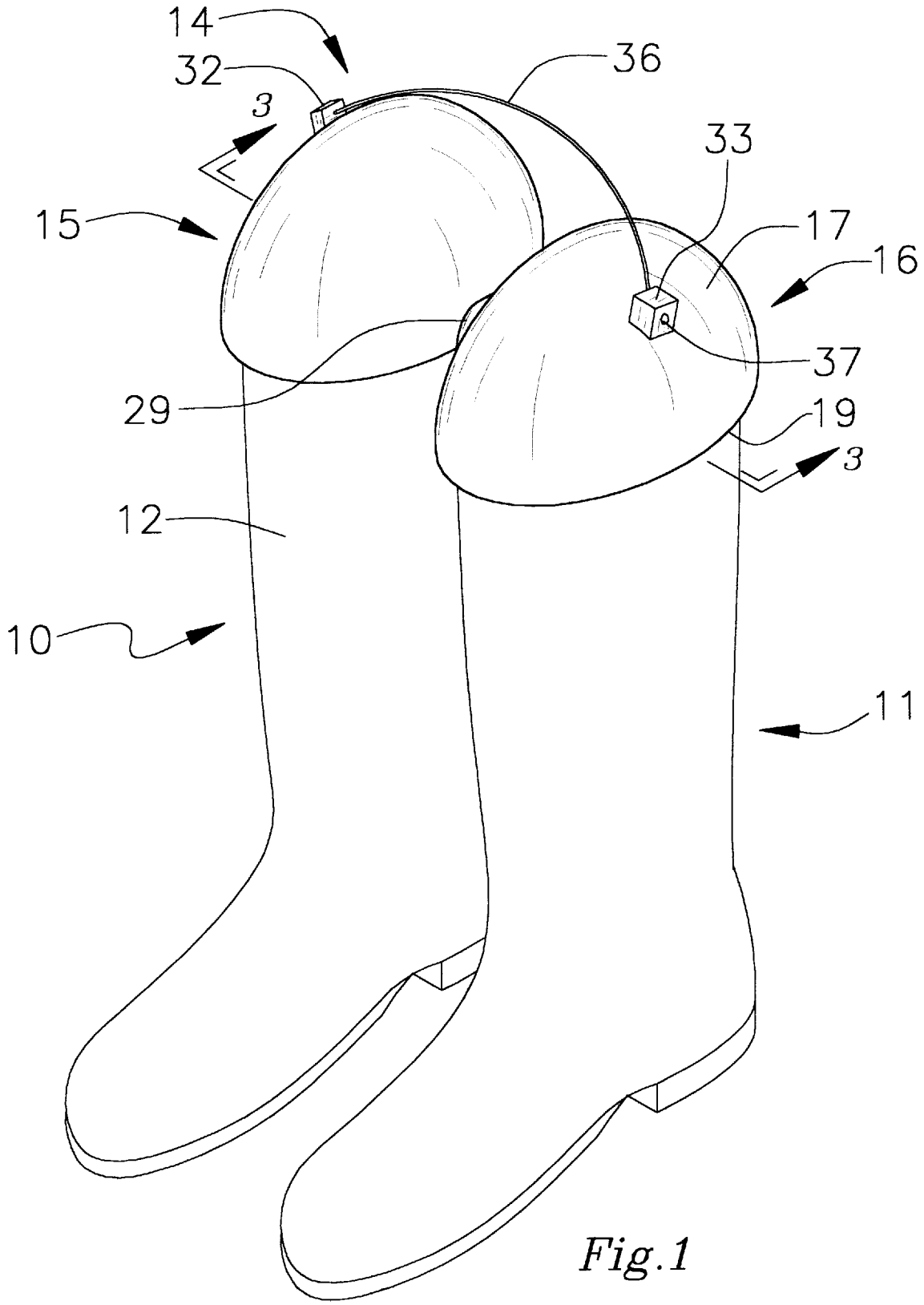
FIG. 1 is a schematic perspective view of a new boot leg opening cover attachment according to the present invention.

With reference now to the drawings, and in particular to FIGS. 1 through 6 thereof, a new boot leg opening cover attachment embodying the principles and concepts of the present invention will be described.

As best illustrated in FIGS. 1 through 6, the boot leg opening cover attachment generally comprises a pair of cover members each having upper and lower faces and a lower perimeter edge. Each of the cover members is designed for position over a boot leg opening of an associated boot to cover the respective boot leg opening. A clip connects the lower perimeter side edges of the cover members together. The clip is designed for attachment to adjacent portions of the boots to attach the cover members to the boots.

In closer detail, the cover attachment is designed for use with a pair of boots 10,11 each having an upwardly extending shaft portion 12 terminating at an upper edge 13 defining an upper leg opening into the respective boot. Typically, the boots comprise rubber boots also known as galoshes and Wellingtons.

The cover attachment 14 includes a pair of cover members 15,16 each having upper and lower faces 17,18 and a lower perimeter edge 19. The cover members each may be generally dome shaped so that the upper faces of the cover members are convex in shape and the lower faces of the cover members are concave in shape. The lower perimeter edges of the cover members each may be generally oval in shape to correspond to the upper edge of the associated boot.

Figure 3:
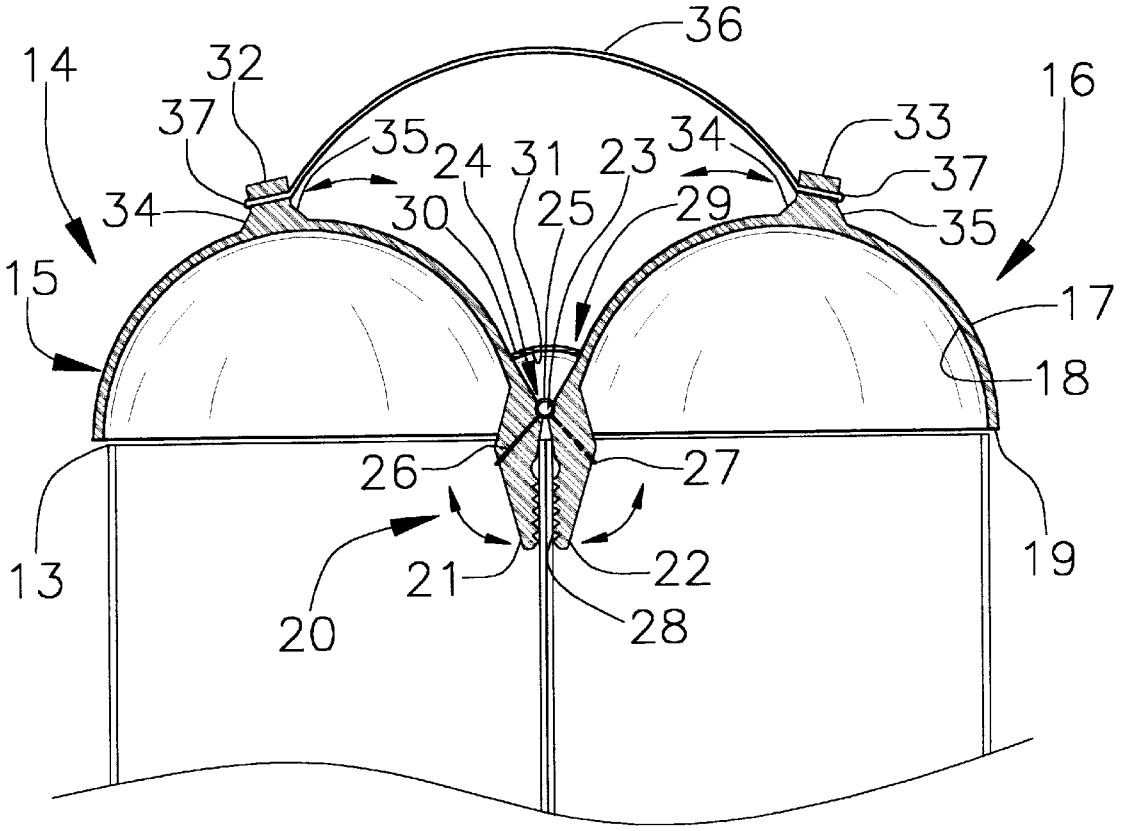
FIG. 3 is a schematic cross sectional view taken from line 3—3 of FIG. 1.
Figure 4:
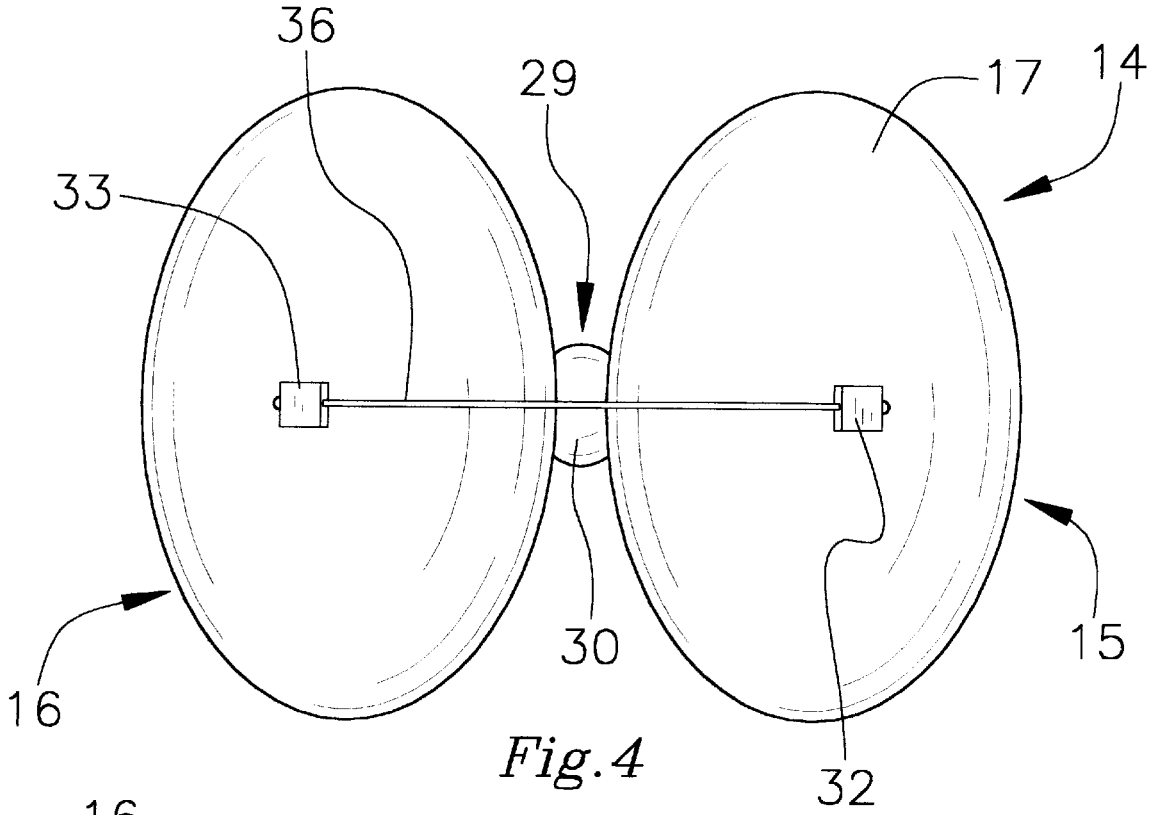
FIG. 4 is a schematic top view of the present invention.
Figure 5:
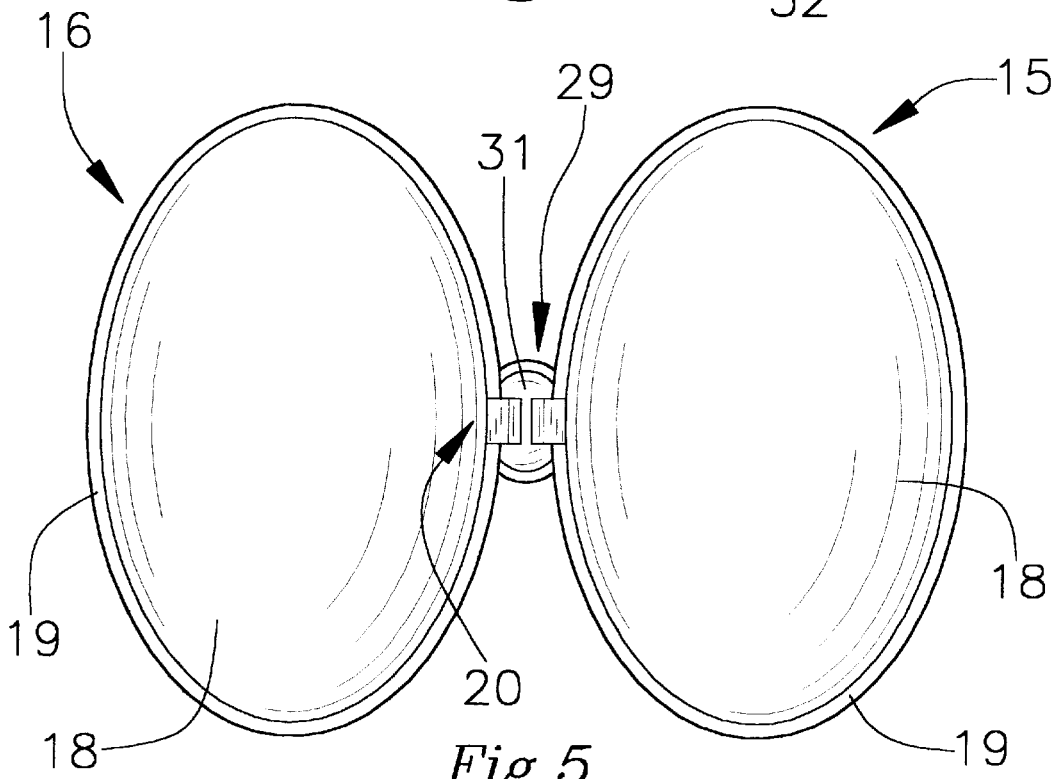
FIG. 5 is a schematic bottom view of the present invention.
Figure 6:
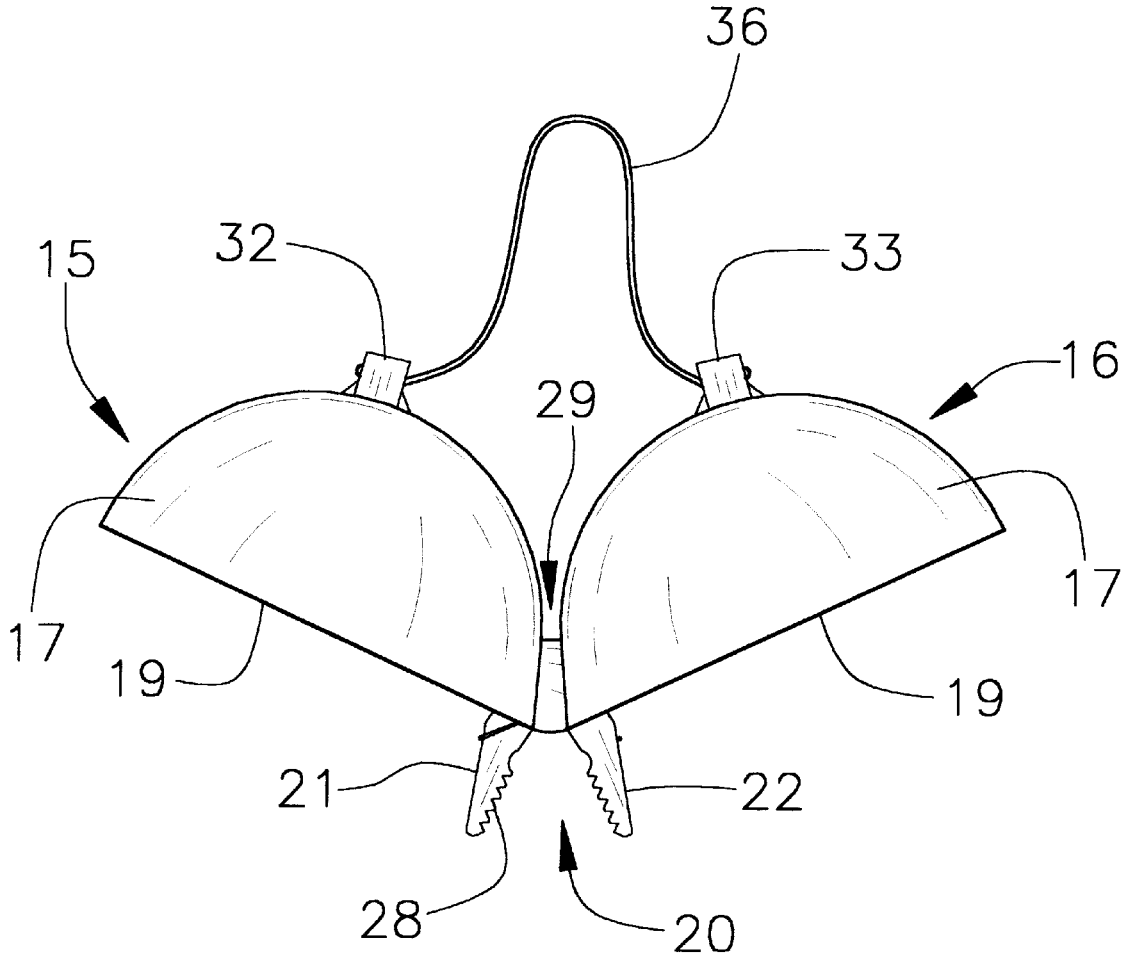
FIG. 6 is a schematic side view of the present invention to a position where the jaws are pivoted apart from each other.

As illustrated in FIGS. 1 and 3, each of the cover members is designed for placing over the upper leg opening of an associated boot to cover the respective upper leg opening to prevent passage of precipitation and other debris into the upper leg openings.

The attachment also includes a clip 20 similar to an alligator clip or clothespin connecting the lower perimeter side edges of the cover members together. As best illustrated in FIG. 3, the clip is designed for attaching the cover members to the shafts of the boots in such a manner that the clip also holds the shafts of the boots together.

The clip has a pair of downwardly extending jaws 21,22. One of the jaws of the clip is coupled to the lower perimeter edge of one of the cover members and the other of the jaws of the clip is coupled to the lower perimeter edge of the other of the cover members. The jaws of the clip are pivotally coupled together at a pivot point 23 in a similar fashion as a clothespin with the pivot point positioned above the jaws of the clip.

The clip may have a spring 24 biasing the jaws towards one another. The spring may have a coiled portion 25 at the pivot point of the clip, a first arm portion 26 mounted to one of the jaws, and a second arm portion 27 mounted to the other of the jaws.

The jaws of the clip each may also have a toothed face 28 with the toothed faces of the jaws facing one another. Each toothed face comprises a plurality of teeth each having a generally triangular cross section.

Figure 2:
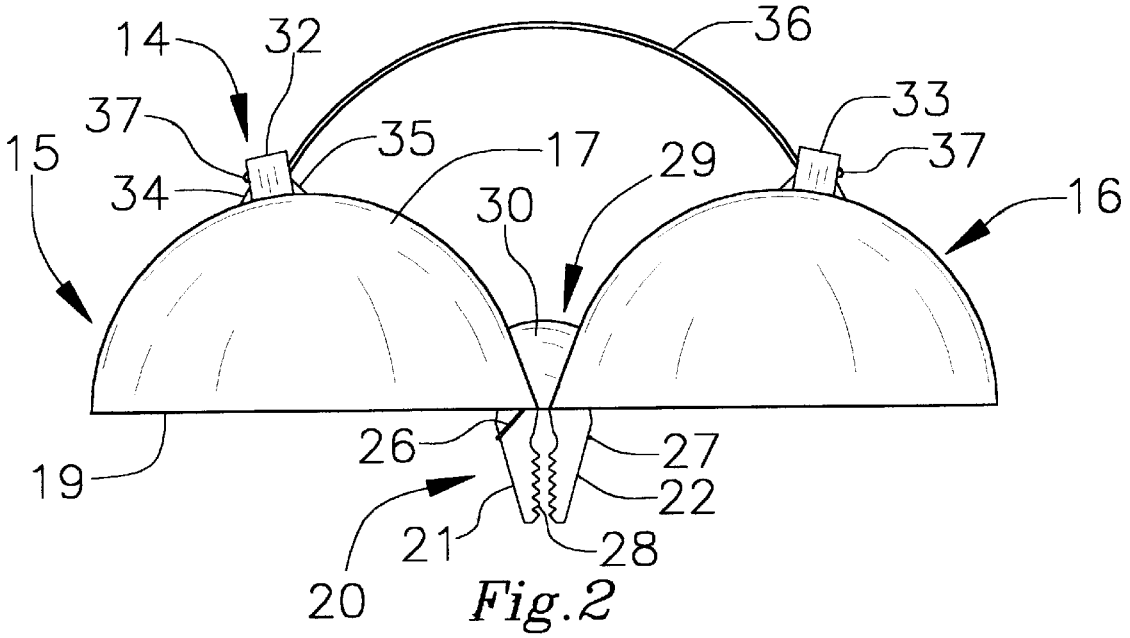
FIG. 2 is a schematic side view of the present invention.

The jaws of the clip are biased by the spring to a position where the lower perimeter edges of the cover members generally lie in a common plane. As illustrated in FIG. 2.

A dome-shaped gaiter 29 may be interposed between the cover members and positioned above the clip. In such an embodiment, the gaiter is coupled to the upper faces of the cover members. The gaiter may have a convex top face 30 and a concave bottom face 31 defining a dome-shaped space above the clip. The gaiter covers the top of the clip to prevent precipitation and debris from falling on the clip.

The gaiter may comprise a flexible material to permit flexing of the gaiter when the jaws are pivoted apart and thereby move the cover members upwardly and towards each other so that the lower perimeter edges are no longer lying in a common plane.

The upper face of each of the cover members may have an outwardly extending stub 32,33. Each stub may have a generally rectangular cross section and a pair of generally triangular reinforcing tabs 34,35 adjacent the upper face of the respective cover member for providing additional structural strength between the union of the cover member and its associated stub. The stubs are extended at an angles away from one another when the lower perimeter edges of the cover members are lying in their common plane. In use, the stubs are designed for grasping with a hand of a user such that the user may squeeze their hand to move the stubs closer together to thereby pivot the jaws of the clip apart from each other.

An elongate flexible element 36 with a pair of opposite ends may also be included. One of the ends of the flexible element is coupled to one of the stubs and the other of the ends of the flexible element is coupled to the other of the stubs such that the flexible element forms a handle for permitting a user to carry or hang the attachment therewith. In one embodiment, each end of the flexible element may be inserted through the associated stubs and secured to the associated stub with a stop 37.

The cover members, the clip, the stubs, and the gaiter each may comprise a water-impermeable material such as a water-impermeable plastic material.

In use, the boots are positioned adjacent each other such that the upper leg openings of the boots are positioned adjacent each other. One of the cover members covers the upper leg opening of one of the boots and the other of the cover members covers the upper leg opening of the other of the boots. The lower faces of the cover members face downwards over the upper leg opening of the associate boot. As illustrated in FIG. 3, each of the jaws of the clip is inserted into the upper leg opening of the associated boot with the shafts of the boots each having a portion positioned between the jaws of the clip. The jaws of the clip are biased towards each other to pinch the portions of the shafts of the boots between the jaws to hold the boots together with the clip.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An attachment for covering boot leg openings of a pair of boots, said attachment comprising:

a pair of cover members each having upper and lower faces and a lower perimeter edge;

each of said cover members being adapted for positioning over a boot leg opening of an associated boot to cover the respective boot leg opening;

a clip connecting said lower perimeter side edges of said cover members together, said clip being adapted for attachment to adjacent portions of the boots to attach said cover members to the boots; and wherein said cover members each are generally dome shaped, said upper faces of said cover members being convex in shape and said lower faces of said cover members being concave in shape.

2. The attachment of claim 1, wherein said lower perimeter edges of said cover members each are generally oval in shape.

3. The attachment of claim 1, wherein said clip has a pair of downwardly extending jaws, one of said jaws of said clip being coupled to said lower perimeter edge of one of said cover members and the other of said jaws of said clip being coupled to said lower perimeter edge of the other of said cover members, said jaws of said clip being pivotally coupled together.

4. The attachment of claim 1, wherein said clip has a spring biasing said jaws towards one another.

5. The attachment of claim 1, further comprising a dome-shaped gaiter being interposed between said cover members and positioned above said clip, said gaiter being coupled to said upper faces of said cover members.

6. The attachment of claim 1, wherein said upper face of each of said cover members have an outwardly extending stub.

7. The attachment of claim 6, further comprising an elongate flexible element having a pair of opposite ends, one of said ends of said flexible element being coupled to one of said stubs and the other of said ends of said flexible element being coupled to the other of said stubs such that said flexible element forms a handle.

8. An attachment for covering boot leg openings of a pair of boots, said attachment comprising:

a pair of cover members each having upper and lower faces and a lower perimeter edge;

each of said cover members being adapted for position over a boot leg opening of an associated boot to cover the respective boot leg opening;

a clip connecting said lower perimeter side edges of said cover members together, said clip being adapted for attachment to adjacent portions of the boots to attach said cover members to the boots; and wherein said clip has a pair of downwardly extending jaws, one of said jaws of said clip being coupled to said lower perimeter edge of one of said cover members and the other of said jaws of said clip being coupled to said lower perimeter edge of the other of said cover members, said jaws of said clip being pivotally coupled together.

9. The attachment of claim 8, wherein said lower perimeter edges of said cover members each are generally oval in shape.

10. The attachment of claim 8, wherein said clip has a spring biasing said jaws towards one another.

11. The attachment of claim 8, wherein said upper face of each of said cover members have an outwardly extending stub.

12. The attachment of claim 8, further comprising an elongate flexible element having a pair of opposite ends, one of said ends of said flexible element being coupled to one of said stubs and the other of said ends of said flexible element being coupled to the other of said stubs such that said flexible element forms a handle.

13. An attachment for covering boot leg openings of a pair of boots, said attachment comprising:

a pair of cover members each having upper and lower faces and a lower perimeter edge;

each of said cover members being adapted for position over a boot leg opening of an associated boot to cover the respective boot leg opening;

a clip connecting said lower perimeter side edges of said cover members together, said clip being adapted for attachment to adjacent portions of the boots to attach said cover members to the boots; and wherein a dome-shaped gaiter being interposed between said cover members and positioned above said clip, said gaiter being coupled to said upper faces of said cover members.

14. The attachment of claim 13, wherein said lower perimeter edges of said cover members each are generally oval in shape.

15. The attachment of claim 13, wherein said clip has a spring biasing said jaws towards one another.

16. The attachment of claim 13, wherein said upper face of each of said cover members have an outwardly extending stub.

17. The attachment of claim 13, further comprising an elongate flexible element having a pair of opposite ends, one of said ends of said flexible element being coupled to one of said stubs and the other of said ends of said flexible element being coupled to the other of said stubs such that said flexible element forms a handle.

* * * * *